United States Patent [19]

Pujolle

[11] 4,177,876

[45] Dec. 11, 1979

[54] PREFABRICATED ELEMENT TO FORM A DOUBLE SOUND INSULATION AND ABSORPTION WALL OF A DWELLING

[75] Inventor: Jean Pujolle, Paris, France

[73] Assignee: Telediffusion de France, Paris, France

[21] Appl. No.: 818,717

[22] Filed: Jul. 25, 1977

[30] Foreign Application Priority Data

Sep. 10, 1976 [FR] France ..... 76 27280

[51] Int. Cl.[2] ..... E04B 1/82

[52] U.S. Cl. ..... 181/284; 181/286; 181/290; 181/295

[58] Field of Search ..... 181/284, 287, 290, 294, 181/296, 225, 202

[56] References Cited

U.S. PATENT DOCUMENTS

| | | | |
|---|---|---|---|
| 2,177,393 | 10/1939 | Parkinson | 181/284 |
| 2,994,112 | 8/1961 | Stephens | 181/295 |
| 3,077,946 | 2/1963 | Wilkins | 181/202 |
| 4,057,123 | 11/1977 | Erickson | 181/295 |

*Primary Examiner*—L. T. Hix

*Assistant Examiner*—Benjamin R. Fuller

*Attorney, Agent, or Firm*—Abraham A. Saffitz

[57] ABSTRACT

Prefabricated element arranged on a single wall of a room for forming a double sound insulating and sound absorbing wall. The prefabricated element provides efficient sound insulation of the room and a total sound absorption of sound waves whose frequency is centered at one of the natural frequencies of the room. The element comprises a frame supporting a flexible panel by means of elastic sealing means, the flexible panel being maintained at a predetermined distance from the single wall due to the thickness of said frame whereby the resonant frequency of the double wall becomes equal to a natural resonant frequency of the room corresponding to sound waves propagating perpendicularly to the single wall. In addition, the prefabricated element may also comprise an additional element placed in the middle of the panel which permits equalization of the natural resonant frequency of the assembly comprising the flexible panel and the additional element to the low natural frequency of the room. This occurs when the frame and the panel of the element are standardized to match one of the low natural frequencies of the room.

4 Claims, 4 Drawing Figures

PREFABRICATED ELEMENT TO FORM A DOUBLE SOUND INSULATION AND ABSORPTION WALL OF A DWELLING

CROSS REFERENCES TO RELATED APPLICATIONS

Applicant hereby makes cross references to his French Patent application PV 76-27280, filed Sept. 10, 1976 and claims priority thereunder following the provisions of 35 U.S.C. 119.

BACKGROUND OF THE INVENTION

1. Field of the Invention

The present invention relates to a prefabricated element for use in a system of sound insulation and absorption for dwellings. More particularly, this invention relates to a prefabricated element placed on a single wall of a room to form a double sound insulation and absorption wall, comprising a frame which supports a flexible panel by means of an elastic sealing means to thereby position the flexible panel at a predetermined distance from the wall.

2. Description of the Prior Art

It is known that certain existing dwellings are insufficiently protected against external sounds coming partly from other rooms situated in the same building and partly from external sounds such as road and railway traffic noise. To improve the sound insulation of a dwelling, prefabricated elements have been placed on at least one of the walls of the dwelling, and notably on the floor and/or under the celling, so that the double wall thus formed allows the sound attenuation coefficient of the single wall to be increased and the elements placed on the wall act as a partial sound absorber, mainly at frequencies less than 300 Hertz.

A prefabricated element of this type comprises a flexible panel of compact material supported parallel to the single wall at a distance d from the latter by parallelepipedal cross members of a frame connected preferably by means of elastic material to the single wall in order to suitably decouple the single wall and the prefabricated element. When the double wall is acted on by sound waves, the flexible panel vibrates at a resonance frequency f which expresed in Hertz is given by the relation (Book entitled "Notions d'acoustiques" by Robert Josse, Editions Eyrolles, 1973, page 157).

$$f=60/\sqrt{md} \qquad (1)$$

where m is equal to the surface mass (mass per area unit of surface) expressed in $kg/m^2$ of a flexible panel which is assumed, according to usual practice, to be very much smaller than that of the single wall and d is the width of the air layer of the double wall expressed in meters. In this case, the sound attenuation coefficient of the double wall increases as a function of the frequency more rapidly than that of the single wall above the frequency f. It is thus preferable to choose a product md as large as possible. This product md is determined by reconciling the size boundaries of the prefabricated element contributing to the reduction in volume of the room and the loading boundaries of the walls dependent on the structure of the room and the requirement to obtain sufficient insulation of the room. Furthermore, since these prefabricated elements are built with standardized dimensions in order to reduce the cost of manufacture, the frequency f is chosen such that it is sufficiently low to allow efficient insulation of existing dwellings, and such that at the same time it corresponds to an annoying frequency determined qualitatively by measurement inside the dwellings.

OBJECTS OF THE INVENTION

Therefore, it is an object of the present invention to provide a prefabricated sound insulation and absorption element reconciling at the same time the efficient insulation of a room and the total sound absorption of sound waves centered on at least one of the low natural frequencies of the room.

SUMMARY OF THE INVENTION

In fact, the poor quality of the sound comfort of a dwelling is aggravated by its natural resonancies, particularly when it is barely furnished and/or has floors which reflect sound well, such as wood parquet floor, plastic tiles or the like. It is known that the natural resonant frequency of a room depends on the geometry of the latter and, in the most common case of parallelepipedic room these frequencies expressed in Hertz are given by the following formula (see above-mentioned book, page 106):

$$F_{p,q,r}=\frac{c}{2}\sqrt{\frac{p^2}{L_x^2}+\frac{q^2}{L_y^2}+\frac{r^2}{L_z^2}} \qquad (2)$$

where p,q,r are positive or zero integers together designated by N; $L_x$, $L_y$, $L_z$ are the dimensions of the room in meters designated together by the letter L; and c is the wave velocity of sound in meters per second equal to 343 meters per second with the atmospheric temperature of 20° C.

It appears that the sound waves centered on the annoying resonant frequencies which are comprised in the low frequency band between 20 and 360 Hertz must be sufficiently absorbed by the walls. In general, for the dimensions of existing dwellings, the number of these annoying resonant frequencies is equal to two, $F_1$ and $F_2$, for each axial direction and correspond to two cases designated by N=1 and N=2 where one of the whole numbers p, q, r is equal to 1 or 2, the other two being equal to zero. Thus, it is preferable to make each double wall so that it has a high absorption power at one of the frequencies $F_1$ and $F_2$.

In accordance with one aspect of the present invention, a prefabricated element arranged on a single wall of a room in order to form a double sound insulating and absorbing wall comprises a frame supporting, via elastic sealing means, a flexible panel at a predetermined distance from the wall, the resonant frequency of the double wall being equal to a natural resonant frequency of the room corresponding to sound waves propagating perpendicularly to the single wall.

Such a prefabricated element preferably has a size and weight defined so that the sound insulation and absorption properties of the room are optimized.

In accordance with one other aspect of the invention, the sound insulation and absorption of a room are optimized by means of a standardized prefabricated element so as to avoid the necessity of constructing many frames of prefabricated elements of different sizes corresponding to the different dimensions of dwellings.

To this end, a prefabricated sound insulation and absorption element embodying the invention comprises an additional element placed in the middle of the panel and having a surface mass such that the resonant frequency of the double wall, including the additional element, is equal to a natural resonant frequency of the room corresponding to sound waves propagating perpendicularly to the single wall.

Thus, the prefabricated element comprises a standardized frame supporting a resonant panel forming with the single wall of the room a double wall having a resonant frequency different from a chosen natural frequency of the room, this panel being separated from the single wall by an air layer of constant width d. In this case, the resonant frequency f of the double wall is made equal to the chosen frequency F of the room by arranging that the surface mass of the panel in such that, by means of an additional element placed at the centre of the panel, the expressions (1) and (2) are satisfied.

In fact, the surface mass of the panel at a constant distance d from the single wall is less or greater than the surface mass determined by the expressions (1) and (2). In the first case, it is always possible to add an additive element to the panel to compensate the difference of surface masses. In the second case, the resonant frequency of the panel must be adjusted to the natural frequency of the room less than that chosen by adding an additional element to the panel in a similar manner to the first case.

The first and second cases correspond generally to N=2 and N=1. Although in the second case, the totally absorbed sound waves are centered on the frequency $F_1$, the sound waves centred on the frequncies of the upper harmonic waves are advantageously absorbed.

In accordance with a further aspect of the invention, in a sound insulation and absorption system at least one single wall of a room comprises prefabricated sound insulation and absorption elements embodying the invention and as defined previously. The number of different standardized elements is thus reduced as a function of the characteristic dimensions of the room.

When the low natural resonant frequencies of the room are very far from each other, the resonant frequencies of the double walls, each formed by a single wall and a panel associated with an additional element, are equal, preferably, to the lowest resonant frequency of the room. Furthermore, in the case where it is desired to reinforce the sound insulation and absorption of all the walls of a room having practically equal characteristic dimensions, the flexible panels of the prefabricated elements placed on the single walls of the room have equal surface mass.

On the contrary, when the characteristic dimensions of the room are different, that is to say when the natural frequencies of the room are different but equally low and annoying, the resonant frequencies of the double walls, each formed by a single wall and a panel associated with an additional element of a group, are equal and different from those of the double walls of the panels associated with the other additional elements belonging to other groups. Thus, the simultaneous improvement by the use of different frequencies in the sound absorption and insulation properties of all the walls of the room is similar to the improvement observed in the case of the panels of the prefabricated elements placed in standardized array on the single walls of the room to be distributed in a number of groups of panels which have been previously standardized and equal to the characteristic frequencies based on the actual dimensions of the room.

Finally, in accordance with another aspect of the invention, two prefabricated elements of the previous type placed on either side of a partition or a prefabricated single wall separating two rooms can reinforce the sound insulation of the single wall and absorb sound waves propagating perpendicularly through the single wall, the resonant frequency of two prefabricated elements being equal to a natural resonant frequency of one of the rooms and to a natural resonant frequency of the other room, respectively.

The partition thus formed can provide an access door from one of the rooms to the other one.

Examples of embodiment of the invention will now be described in more detail with reference to the accompanying drawings.

DESCRIPTION OF THE PREFERRED EMBODIMENTS

Figure 1:
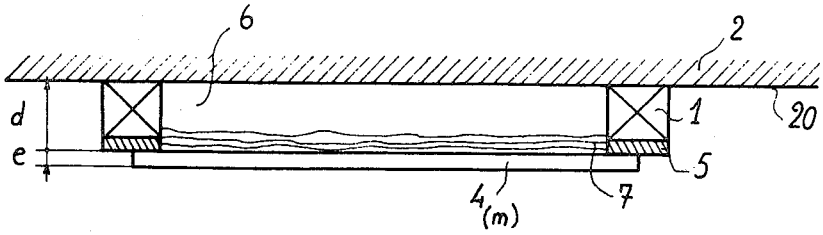
FIG. 1 is a cross-sectional view of a prefabricated element placed on a single wall of a room.
Figure 2:
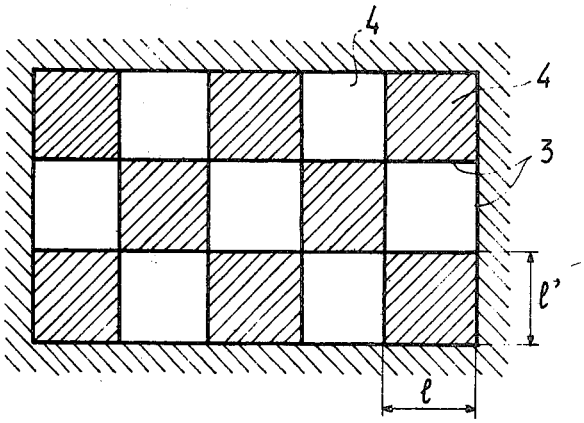
FIG. 2 is a diagram showing the arrangement of a system of prefabricated elements placed on a single wall of a room.

Referring to FIGS. 1 and 2, a prefabricated sound absorption and insulation element comprises a standardized frame formed of parallelepipedal cross members 1 in contact with and parallel to a single wall 2 of a parallelepipedal room to be insulated and forming a frame 3 of dimensions $l \times l'$, for example square. This frame 3 supports, at a distance d from the single wall 2, a flexible panel 4 having a thickness e, by means of a seal 5 of resilient material, such as rubber one centimeter thick for example. The assembly of prefabricated elements placed on the wall 2 forms a grill-like structure as shown in FIG. 2, over the whole surface 20 of the wall 2 inside the room.

In order to eliminate the undesirable effects of stationary waves set up in the layer of air 6 between the flexible panel 4 and the surface 20 of the wall 2, and to reinforce the insulation of the wall, an absorbant material 7, such as mineral wool, is fixed against the panel 4 in the air layer 6.

In accordance with a first variant embodying the invention, the flexible panel 4 has a surface mass m such that its resonant frequency f is equal to one of the natural resonant frequencies of the room which are most annoying. If L is the dimension of the room in a direction perpendicular to the single wall 2, m is subtracted from the equality of the expressions (1) and (2):

$$m = 3600 \times 4(L-d-e)^2/(dc^2N^2) \quad (3)$$

For a standardized frame defined for a constant distance d and for an upper limit of the thickness e selected as a function of the loading and size boundaries of the single wall 2 of the room, it generally appears that the frequency $F_2$ defined for N=2 is the most annoying, the frequency $F_1$ (N=1) being hardly noticeable. To this frequency $F_2$ corresponds a surface mass $m_2$ which is relatively low.

In accordance with the second variant embodying the invention, N is equal to 1 and defines a surface mass $m_1$ four times greater than $m_2$. The insulation of the room by the double wall is notably more efficient than that in accordance with the first variant and the sound waves centered on the harmonic waves of frequency $F_1$ are absorbed as already explained.

Figure 3:
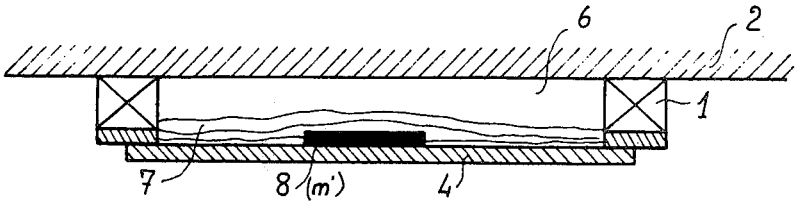
FIG. 3 is a cross-sectional view of another prefabricated element including an additional element.

In accordance with a third variant embodying the invention, the surface mass m of the panel 4 is either less than $m_1$ and greater than $m_2$, or less than $m_2$. In each case, an additional element 8, having a surface mass m', less than $m_1$ or than $m_2$, is stuck to the center of the panel 4 and is contiguous with the air layer 6 as shown in FIG. 3. The mass M' of the additional element 8 is determined by the expression:

$$M' = ((m_1 \text{ or } m_2) - m) \times l' \times l \quad (4)$$

so as to keep the standardized mounting with the same cross members 1 and seal 5 and the same width d of the air layer 6.

It appears thus that all the materials generally used for the sound insulation of the dwellings, having surface mass generally less than 30 kilograms per square meter, can be advantageously used with the same standard frame.

According to another embodiment, the surface 20 of the single wall is covered with prefabricated elements of two standardized types distributed in equal numbers and alternatively on each horizontal line and on each vertical column of the single wall for example, as shown in FIG. 2, by the flexible panels 4 which are shaded and which are not shaded. These two types of flexible panels absorb the axial sound wves centered respectively on frequencies $F_1$ and $F_2$. These flexible panels, having their resonant frequencies equal respectively to the frequencies $F_1$ and $F_2$, owing to the additional suitable elements, can be mounted advantageously on identical standardized frames and, consequently, form a double wall not tending to come apart contrary to the expectations which are known for certain prefabricated known elements in non-standardized application and having their thicknesses d of air layers different in order to absorb two of the frequencies.

Figure 4:
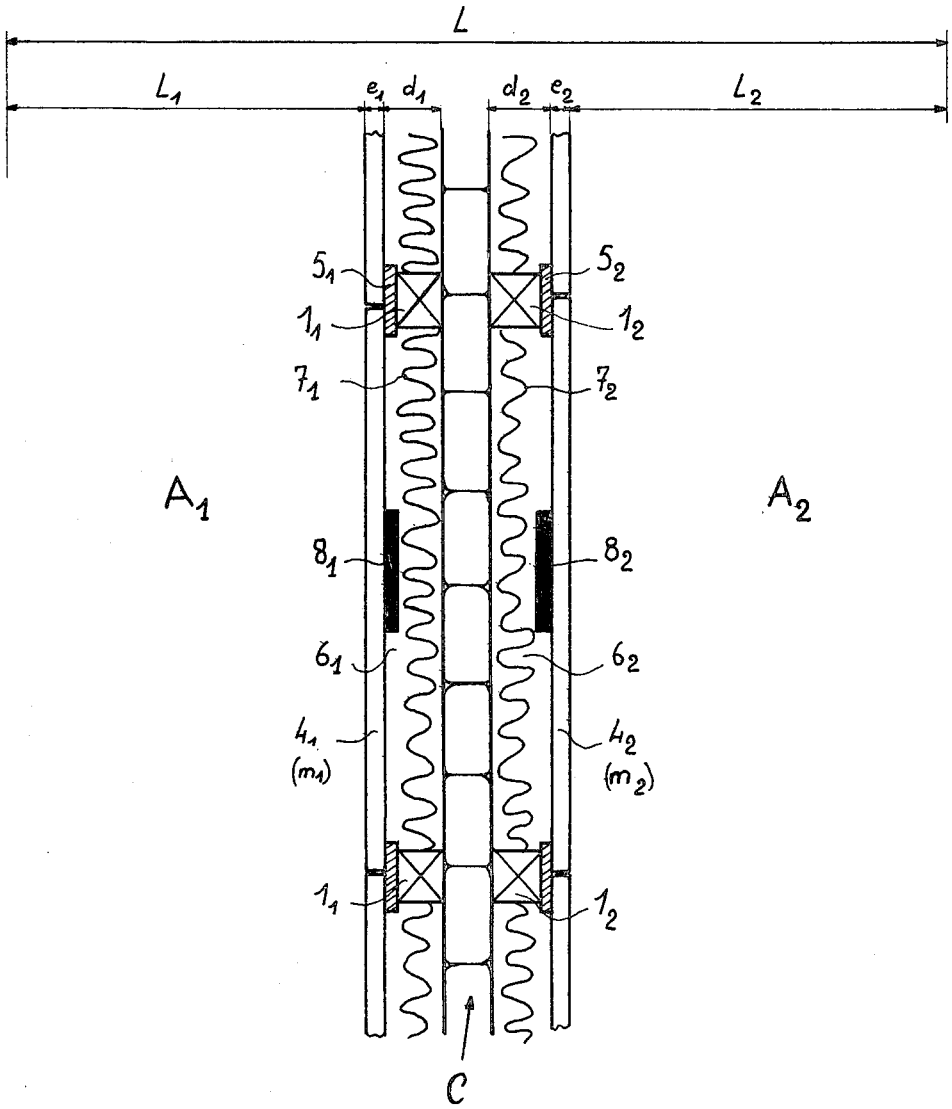
FIG. 4 is a cross-sectional view of two prefabricated elements forming a partition between two rooms.

Finally, according to another embodiment of the present invention, two prefabricated elements with flexible panels $\mathbf{4}_1$ and $\mathbf{4}_2$ are placed on each side of a prefabricated partition or single wall C and separated from the latter by two air layers $\mathbf{6}_1$ and $\mathbf{6}_2$ having thicknesses $d_1$ and $d_2$ filled with an insulating material $\mathbf{7}_1$ and $\mathbf{7}_2$ and connected to the partition C by means of standardized frames formed of parallelepipedal cross members $\mathbf{1}_1$ and $\mathbf{1}_2$ supporting on either side elastic seals $\mathbf{5}_1$ and $\mathbf{5}_2$ in a similar manner to the previously described prefabricated element. The appropriate horizontal stacking of such prefabricated elements allows a partition to be formed separating two small rooms $A_1$ and $A_2$ of length of $L_1$ and $L_2$ of a large room of length L, as shown in FIG. 4. In this case, the two panels $\mathbf{4}_1$ and $\mathbf{4}_2$ having surface masses $m_1$ and $m_2$ are coupled to the partition C and vibrate at frequencies $f_1$ and $f_2$ given by the expressions:

$$f_1 = 60/\sqrt{m_1 d_1} \text{ and } f_2 = 60/\sqrt{m_2 d_2} \quad (5)$$

It is assumed that the surface masses $m_1$ and $m_2$ are small in relation to the surface mass of the partition C.

The resonant frequencies $F_1^1$, $F_2^1$ and $F_1^2$, $F_2^2$ of the small rooms $A_1$ and $A_2$ are given by expressions similar to the expression (2), respectively for N equals 1 and 2.

The frequencies $f_1$ and $f_2$ of the prefabricated elements are made equal with the chosen natural resonant frequencies of the two small rooms $A_1$ and $A_2$ by means of additional elements $\mathbf{8}_1$ and $\mathbf{8}_2$ when the surface masses of the prefabricated elements $m_1$ and $m_2$ are less than those determined by the equalities of the frequency $f_1$ with $F_1^1$ or $F_2^1$ and the frequency $f_2$ with $F_1^2$ of $F_2^2$.

In addition, such panels mounted on a beam of appropriate dimensions allows an access door between two rooms of a dwelling to be provided in order to insulate each room from internal and external noises of the building and, on the other hand, internal noises from the other room.

APPLICATION

By way of example, the sound insulation of a single wall as a ceiling or a floor of an existing dwelling is described hereafter. The current construction regulations determine the height of the dwelling as being equal to:

$$L_z = 2.6\ m \quad (6)$$

For a plywood panel placed against the wall and having a surface mass m equal to 4.7 kilograms per square meter, the expression (3) gives the following:

$$d = 42 \text{ mm and } e = 8 \text{ mm for } N = 2 \quad (7)$$

This corresponds to the natural frequency $F_2$ of the room equal to 128 Hertz. This frequency $F_2$ has been selected because it is the most annoying, the frequency $F_1$ corresponding approximately to the second normalized octave (63 Hertz) and not belonging to the range of perceptible low frequencies.

According to the second variant embodying the invention, the rooms are insulated in a more efficient manner and, consequently, panels having higher surface masses are used. In this case, the absorption of the panels is adjusted to the natural frequency $F_1$ of the room (67 Hertz). The panel is then, for example, formed of plaster-board having a thickness of 13 mm and a surface mass equal to 19 kilograms per square meter.

According to the third variant embodying the invention, the panel has a surface mass m, either less than 4.7 kilograms per square meter, or less than 19 kilograms per square meter. In these two cases, for a standardized element with a square panel having dimensions of 0.6 m×0.6 m, the mass M' of the additional elements is given by the expression (4), respectively:

$$M' = (4.7 - m) \times 0.36 \text{ kg and}$$

$$M' = (19 - m) \times 0.36 \text{ kg} \quad (8)$$

When the height $L_z$ under the ceiling of the room is different from 2.6 m, the panel is still mounted on the same standardized frame having a thickness d equal to 42 mm, has a surface mass given by the expression (3) corresponding to the two above-mentioned cases:

$$m = 0.73(L_z - (0.042 + e))^2 \text{ kg/m}^2 \text{ for } N = 2$$

$$m = 4 \times 0.73(L_z - (0.042 + e))^2 \text{ kg/m}^2 \text{ for } N = 1 \quad (9)$$

If standardized frames are used for the previous prefabricated elements, the additional centrally placed elements are determined by combining the expressions (8) and (9). The determination of the material would obviously be easier if tables or craft are used which represent the variations of the surface masses m and m' as a function of $L_z$, d and e.

The previously determined prefabricated elements have produced a good sound insulation with standardized wooden frames having a thickness d of 4.2 cm with cross members having sections 4 cm×3.2 cm and for which the elastic seal has a section of 4 cm×1 cm.

What is claimed is:

1. A sound absorbing and sound insulating structure wherein a single wall of a room having an annoying natural resonant frequency is covered with a plurality of prefabricated structures, each prefabricated structure comprising:

a four sided frame having parallel cross members for attachment to the wall, said cross members each having a height d to space a flexible panel member attached to said frame by said distance d from said wall;

a flexible panel member adhesively secured to said cross member at said distance d from said wall having a surface mass much smaller than the surface mass of said wall;

an additional surface mass adjustment element fixed to the side of said panel member which is inside the air space between the panel member and said wall; said additional adjustment element serving as the sole means for adjusting the surface mass of the structure so that the resonant frequency of the panel supporting said additional element is equal to a natural resonant frequency of said room after installation;

an elastic adhesive bonding said flexible panel member to said cross member;

the flexible panel members being of at least two different resonant frequencies due to differences in their surface mass, these differences taking into account the masses of the additional elements whereby each prefabricated structure and adjacent panel member on a wall has a different resonant frequency to provide an array of at least two flexible panel assemblies at a common distance d from the wall.

2. A structure as claimed in claim 1, wherein an array is provided on each side of a common wall between two rooms.

3. A structure as claimed in claim 1, wherein the frames and panels of adjacent prefabricated structures are of identical size but different in surface mass.

4. A structure as claimed in claim 1 wherein said panel member is provided with mineral wool adhesively secured to its inner surface which occupies part of the air space to eliminate stationary sound waves therein.

* * * * *